US010156354B2

(12) United States Patent
Lv et al.

(10) Patent No.: US 10,156,354 B2
(45) Date of Patent: Dec. 18, 2018

(54) CIRCULATING FLUIDIZED BED BOILER

(75) Inventors: Qinggang Lv, Beijing (CN); Yunkai Sun, Beijing (CN); Guoliang Song, Beijing (CN); Dongyu Wang, Beijing (CN); Shaolin Bao, Beijing (CN); Ming Gao, Beijing (CN); Shiyuan Li, Beijing (CN)

(73) Assignee: Institute of Engineering Thermophysics, Chinese Academy of Sciences, Beijing (CN)

( * ) Notice: Subject to any disclaimer, the term of this patent is extended or adjusted under 35 U.S.C. 154(b) by 650 days.

(21) Appl. No.: 13/882,428

(22) PCT Filed: Oct. 27, 2011

(86) PCT No.: PCT/CN2011/081402

§ 371 (c)(1),
(2), (4) Date: Jul. 10, 2013

(87) PCT Pub. No.: WO2012/055364

PCT Pub. Date: May 3, 2012

(65) Prior Publication Data

US 2013/0284119 A1 Oct. 31, 2013

(30) Foreign Application Priority Data

Oct. 29, 2010 (CN) ..... 2010 1 0531433

(51) Int. Cl.
*F22B 31/00* (2006.01)
*F23C 10/18* (2006.01)
(Continued)

(52) U.S. Cl.
CPC ..... *F22B 31/003* (2013.01); *F22B 21/02* (2013.01); *F22B 31/0084* (2013.01); *F23C 10/10* (2013.01); *F23C 10/18* (2013.01)

(58) Field of Classification Search
CPC .... F22B 31/003; F22B 31/0084; F22B 21/02; F23C 10/10; F23C 10/18
(Continued)

(56) References Cited

U.S. PATENT DOCUMENTS 4,475,472 A * 10/1984 Adrian ..... F23C 10/002 110/211
4,733,621 A † 3/1988 Kostamo
(Continued)

FOREIGN PATENT DOCUMENTS

CA 2159949 A1 4/1997
CN 2037430 U 5/1989
(Continued)

OTHER PUBLICATIONS

"Chinese Application Serial No. 201010531433.1, Office Action dated Jul. 17, 2013", (w/ English Translation), 15 pgs.
(Continued)

*Primary Examiner* — Steven B McAllister
*Assistant Examiner* — Benjamin W Johnson
(74) *Attorney, Agent, or Firm* — Schwegman Lundberg & Woessner, P.A.

(57) ABSTRACT

A circulating fluidized bed boiler is disclosed. The circulating fluidized bed boiler comprising: a furnace defined and enclosed by water walls, a ceiling and an air distributor, the water walls comprising front and rear walls and left and right side walls (AJ, TK) formed by water cooling tubes, and the water walls are provided with secondary air ports (Y) in the lower part thereof, and furnace flue gas outlets (AB, EF, IJ, KL, OP, ST) being provided in an upper part of the furnace; at least two cyclones connected with the furnace flue gas outlets (AB, EF, IJ, KL, OP, ST); a loop-seal is connected with solid outlets of the cyclones and the lower part of the furnace, respectively; and a flue gas duct connected with flue
(Continued)

gas outlets of the cyclones wherein the water cooling wall tubes of the water wall form at least one vertical columnar recessed segment (BCDE, FGHI, SRQP, ONML) recessed toward the inside of the furnace, and the at least one columnar recessed segment (BCDE, SRQP, ONML) extends at least 15% of the furnace height in a vertical direction.

6 Claims, 5 Drawing Sheets

(51) Int. Cl.
*F23C 10/10* (2006.01)
*F22B 21/02* (2006.01)

(58) Field of Classification Search
USPC ..... 122/4 D, 6 A, 58 FB, 235.12, 235.14
See application file for complete search history.

(56) References Cited

U.S. PATENT DOCUMENTS

| | | | | |
|---|---|---|---|---|
| 5,094,191 | A * | 3/1992 | Garkawe | F22B 31/0084 122/235.12 |
| 5,215,042 | A | 6/1993 | Beisswenger et al. | |
| 5,707,591 | A † | 1/1998 | Semedard | |
| 5,836,257 | A * | 11/1998 | Belin | F22B 31/0084 110/234 |
| 6,039,008 | A * | 3/2000 | Anderson | F22B 31/0084 122/4 D |
| 6,808,390 | B1 * | 10/2004 | Fung | C10B 49/10 110/245 |
| 7,244,400 | B2 | 7/2007 | Darling | |
| 2001/0006769 | A1 † | 7/2001 | Malaubier | |
| 2005/0112037 | A1 * | 5/2005 | Darling | F22B 31/003 422/139 |
| 2007/0079773 | A1 | 4/2007 | Morin | |
| 2009/0084293 | A1 * | 4/2009 | Morin | F22B 21/02 110/245 |
| 2012/0134882 | A1 † | 5/2012 | Lankinen | |

FOREIGN PATENT DOCUMENTS

| | | | |
|---|---|---|---|
| CN | 2111446 | U | 7/1992 |
| CN | 1445477 | A | 10/2003 |
| CN | 101050584 | A | 10/2007 |
| CN | 101050854 | A | 10/2007 |
| CN | 101067492 | A | 11/2007 |
| CN | 101196297 | A | 6/2008 |
| CN | 101240893 | A | 8/2008 |
| CN | 100523606 | C | 8/2009 |
| CN | 101749697 | A | 6/2010 |
| CN | 102226518 | A | 10/2011 |
| JP | 08-261441 | A | 10/1996 |
| WO | WO-2010/116039 | A1 | 10/2010 |
| WO | WO 2010/142861 | A2 * | 12/2010 |
| WO | WO-2010/142861 | A2 | 12/2010 |

OTHER PUBLICATIONS

"Chinese Application Serial No. 201010531433.1, Office Action dated Jan. 6, 2014", (w/ English Translation), 14 pgs.
"Korean Office Action Ser.No. 2013-7013404, Office Action dated Apr. 10, 2014", (w/ English Summary), 4 pgs.
"International Application Serial No. PCT/CN2011/081402, International Preliminary Report on Patentability dated Apr. 30, 2013",(w/ English Translation), 14 pgs.
"International Application Serial No. PCT/CN2011/081402, International Search Report dated Jan. 19, 2012", (w/ English Translation), 6 pgs.
"International Application Serial No. PCT/CN2011/081402, Written Opinion dated Jan. 19, 2012", (w/ English Translation), 12 pgs.
Hotta, A., et al., "Milestones for CFB and OTU Technology—The 460 MWe Lagisza Design Supercritical Boiler Project Update", presented in CoalGen Conference, (Milwaukee, WI), (Aug. 2007), 9 pgs.
Jiang, M.-H., et al., "Research and Development of Large CFB boilers in China", *Proceedings of the CSEE,* vol. 27, No. 23, (w/ English Abstract), (Aug. 2007), 1-6.
Morin, J.-X., "Recent Alstom Power Large CFB and Scale up aspects Including steps to Supercritical", *47th International Energy Agency Workshop on Large Scale CFB,* (Zlotnicki, Poland, Oct. 13, 2003), (2003), 1-15.
"European Application Serial No. 11835637.7 Extended European Search Report dated Jun. 2, 2017", (dated Jun. 2, 2017), 8 pgs.
"Indian Application Serial No. 4508DELNP2013 Office Action dated Sep. 18, 2018", w/English Translation, (dated Sep. 18, 2018), 5pgs.

* cited by examiner
† cited by third party

CIRCULATING FLUIDIZED BED BOILER

RELATED APPLICATIONS

This application is a U.S. National Stage Application filed under 35 U.S.C § 371 of International Application Serial No. PCT/CN2011/081402, filed on Oct. 27, 2011, and published on May 3, 2012 as WO 2012/055364 A1, which application claims priority to Chinese Application No. 201010531433.1, filed Oct. 29, 2010, both of which applications and publication are incorporated herein by reference in their entireties.

FIELD OF THE INVENTION

The present invention relates to a large-size circulating fluidized bed boiler, in particular to the furnace of a circulating fluidized bed boiler.

DESCRIPTION OF THE RELATED ART

With the scaling up of a circulating fluidized bed boiler, the area of furnace cross section and air distributor should be larger correspondingly. Thereby, the distance between a secondary air outlet in a side wall of the furnace and the center region of the furnace becomes longer. Furthermore, the increase in the density of particles in furnace leads to greater resistance for the secondary air transversely penetrating to the center region of the furnace. The oxygen can be transversely moved, in the region beyond the penetration distance of the secondary air, only by a transverse mixing of materials, which is rather difficult. Accordingly, the insufficient penetration of the secondary air in the furnace is a great challenge for large-size circulating fluidized bed boiler.

A conventional solution for the above challenge is to divide the furnace into two dense-phase zones, for example, the pantleg of the lower part of Lurgi combustion chamber, and two divisive parallel beds of Pyroflow combustion chamber. To some extent, these measures can solve the issue of the insufficient penetration of the secondary air in the bottom of the furnace. However, it is required to enhance the operation performance of circulating fluidized bed boiler, and particularly the even fluidization in the furnace.

In order to solve the issue of the secondary air penetration, it is mentioned in a disclosed Chinese Patent No. 200710151813.0 that a water-cooling column is provided at the center of the furnace and the secondary air port is set in the water-cooling column, and then the secondary air is blown from the center. However, there is higher requirement for the design of the water-cooling column, and the improper design will affect the flow field of the furnace and the inlet of cyclone. Furthermore, since the water-cooling column is located in the furnace, it is inconvenient for the maintenance.

Furthermore, with the scaling-up and high-parameter of circulating fluidized bed boiler, a ratio of the dimension to surface area of the furnace increases, which makes it difficult to match the combustion and heat transfer in the furnace. In order to control the bed temperature of the furnace and the flue gas temperature at the furnace outlet within an appropriate range, there are usually two solutions. The first one is to increase heating surface in the furnace to absorb the excessive heat. However, such solution will bring some difficulty in the seal, inflation and anti-abrasion of the furnace, and cause uneven heat absorbance of the upper part of the furnace and make the temperature of the upper part of the furnace and the flue gas temperature at the furnace outlet relatively lower.

The second solution is to arrange heating surface outside the furnace, for example, an external heat exchanger. The temperature of the circulating ash is reduced by the heating surface in the external heat exchanger, so that the bed temperature of the furnace is controlled. However, the external heat exchanger increases the cost of manufacture, operation and maintenance of the whole boiler system, and meanwhile it puts forwards a strict request on the overall arrangement and operation adjustment of the circulating fluidized bed boiler.

SUMMARY OF THE INVENTION

The present invention has been made to overcome or alleviate at least one aspect of the above mentioned disadvantages.

Accordingly, it is an object of the present invention to provide a circulating fluidized bed boiler which can improve the secondary air penetration and/or increase the area of water wall in the furnace.

According to one aspect of the present invention, a circulating fluidized bed boiler is provided, the boiler comprising a furnace defined and enclosed by a water wall, a ceiling and an air distributor, the water wall comprising front and rear walls and left and right side walls formed by water cooling wall tubes, the water wall being provided with secondary air ports in the lower part thereof, and furnace flue gas outlets being provided in the upper part of the furnace; at least two cyclones connected to the furnace flue gas outlets; a loop-seal connected to solid outlets of the cyclones and the lower part of the furnace, respectively; and a flue gas duct connected to flue gas outlets of the cyclones, wherein the water cooling wall tubes of the water wall form at least one vertical columnar recessed segment recessed toward the inside of the furnace, and the columnar recessed segment extends at least 15% of the height of the furnace in a vertical direction.

Optionally, the columnar recessed segment extends from the air distributor to a position lower than the furnace flue gas outlets and higher than the secondary air ports in the vertical direction. Or optionally, the columnar recessed segment extends in the vertical direction from a position higher than the air distributor and lower than the secondary air ports of the furnace to a position lower than the furnace flue gas outlets and higher than the secondary air ports of the furnace. It is preferred that the top of columnar recessed segment is a flat surface extending toward the inside of the furnace. Furthermore, an afterburning air port is provided on or above the flat surface. It is preferred that when the mentioned columnar recessed segment is provided in the left and right side walls, the depth by which the columnar recessed segment is recessed toward the inside of the furnace is not larger than a half of the difference between the width of the furnace and the air distributor; when it is provided in the front and rear walls, the depth by which the columnar recessed segment is recessed toward the inside of the furnace is not larger than a half of the difference between the depth of the furnace and the air distributor.

Optionally, the cross section shape of the columnar recessed segment can be one of the following: half circle, half oval, half oblong, rectangle, triangle, isosceles trapezoid and half octagon.

Optionally, the columnar recessed segment extends from the air distributor to the ceiling in the vertical direction, and in a cross section of the furnace the columnar recessed segment is located between adjacent furnace flue gas outlets or/and outside the furnace flue gas outlets and does not overlap with the furnace flue gas outlets.

Further optionally, the furnace comprises three furnace flue gas outlets provided in an upper part of the rear wall and connected to three cyclones respectively; and the rear wall is provided with two columnar recessed segments with one arranged between one pair of adjacent furnace flue gas outlets of the three furnace flue gas outlets and the other arranged between the other pair of adjacent furnace flue gas outlets of the three furnace flue gas outlets. It is preferred that when the columnar recessed segments are provided in the rear wall, the depth by which the columnar recessed segments are recessed toward the inside of the furnace is not larger than a half of the difference between the depth of the furnace and air distributor.

Or further optionally, the furnace comprises two furnace flue gas outlets provided in an upper part of the left side wall and two furnace flue gas outlets provided in an upper part of the right side wall, and these four furnace flue gas outlets are connected with four cyclones respectively; and the left side wall is provided with one columnar recessed segment arranged between the two furnace flue gas outlets in the upper part of the left side wall, and the right side wall is provided with one columnar recessed segment arranged between the two furnace flue gas outlets in the upper part of the right side wall. It is preferred that when the columnar recessed segments are provided in the left and right side walls, the depth by which the columnar recessed segments are recessed toward the inside of the furnace is not larger than a half of the difference between the width of the furnace and the width of the air distributor.

Or further optionally, the furnace comprises three furnace flue gas outlets provided in an upper part of the left side wall and three furnace flue gas outlets provided in an upper part of the right side wall, and these six furnace flue gas outlets are connected with six cyclones, respectively; the left side wall is provided with two columnar recessed segments with one arranged between one pair of adjacent furnace flue gas outlets in the left side wall and the other arranged between the other pair of adjacent furnace flue gas outlets in the left side wall; and the right side wall is provided with two columnar recessed segments with one arranged between one pair of adjacent furnace flue gas outlets in the right side wall and the other arranged between the other pair of adjacent furnace flue gas outlets in the right side wall. It is preferred that when the columnar recessed segments are provided in the left and right side walls, the depth by which the columnar recessed segments are recessed toward the inside of the furnace is not larger than a half of the difference between the width of the furnace and the width of the air distributor.

It is especially preferred that the at least one columnar recessed segment is provided with secondary air ports.

With the water cooling tubes forming at least one vertical columnar recessed segment toward the inside of the furnace, the circulating fluidized bed boiler of the present invention can achieve at least one of the following technical effects:

(1) The secondary air can easily reach the center region of the furnace, solving the problem of the poor penetration of the secondary air, and improving the performance of combustion and discharge of circulating fluidized bed boilers;

(2) More heating surface can be arranged in the furnace, which can effectively absorb the combustion heat generated in the furnace, resulting in better control of the bed temperature of the furnace and the flue gas temperature at the furnace outlet; and (3) When the vertical columnar recessed segment is located outside the furnace, it is convenient for the overhaul and maintenance.

BRIEF DESCRIPTION OF THE DRAWINGS

The above and other features of the present invention will become more apparent by describing in detail the exemplary embodiments thereof with reference to the accompanying drawings, in which.

Figure 1:
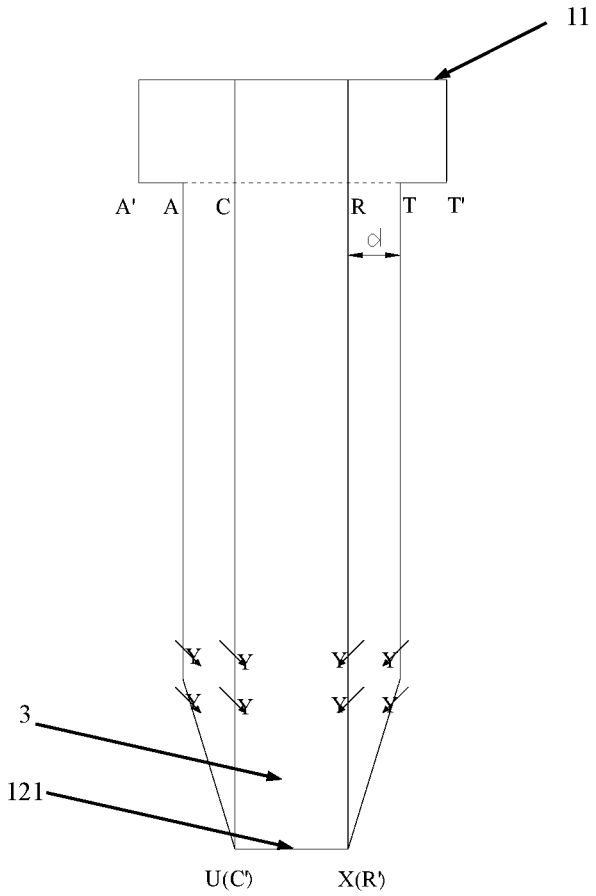
FIGS. 1 and 2 are illustrative front and top views of a circulating fluidized bed boiler according to an exemplary embodiment 1 of the present invention, respectively.

In the above drawings, the front and top views only show the shapes of furnace and cyclone inlet flue gas duct, and the cyclone and the loop-seal are not shown.

DETAILED DESCRIPTION OF PREFERRED EMBODIMENTS OF THE INVENTION

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

The furnace cross section of circulating fluidized bed boiler is usually rectangle, which is enclosed by four water walls, the front and rear walls and the left and right side walls. An air distributor 12 is provided with a primary air port 121. The secondary air ports are provided in the lower part of the water walls in order to blow the secondary air into the furnace.

When there is one to three cyclones 2, the flue gas outlets 21 of the furnace are usually provided in the upper part of the rear wall, and the cyclones are located between the furnace rear wall and flue gas duct. In this condition, the lower parts of the front and rear walls are usually bent inward so that the depth of air distributor 12 is less than that of the middle-upper part of the furnace.

When the number of cyclone is four or more, the flue gas outlets of the furnace are usually provided in upper parts of the left and right side walls, and the cyclones are located outside the left and right side walls. In this condition, the lower parts of the left and right side walls are usually bent inward so that the width of air distributor is less than that of the middle-upper part of the furnace.

In the present invention, there is at least one vertical columnar recessed segment which is recessed toward the inside of the furnace and is formed by water cooling tubes, and which extends at least 15% of the height of the furnace in a vertical direction. When one or more vertical columnar recessed segments are formed in the water walls, a portion of the water walls is recessed toward the inside of the furnace, which will increase the area of the water walls. The columnar recessed segments are also constructed by the water cooling tubes, becoming a part of the furnace water walls. There are various shapes for the cross section of the columnar recessed segment, for example, half circle, half oval, half oblong, rectangle, triangle, isosceles trapezoid, half octagon or a combination of the rectangle and the triangle. In other words, in case where the furnace cross section of the circulating fluidized bed boiler is rectangle, the furnace with columnar recessed segments has the cross section of a rectangle shape with a half circle notch, a half oval notch, a half oblong notch, a rectangle notch, a triangle notch, an isosceles trapezoid notch or a half octagon notch, and the widest notch is at a flat surface where the water wall is not recessed.

The columnar recessed segment may extend from the air distributor to a position lower than the flue gas outlets of the furnace and higher than the secondary air ports in the vertical direction. Or optionally, the columnar recessed segment may extend from a position higher than the air distributor and lower than the secondary air ports of the furnace to a position lower than the flue gas outlets of the furnace and higher than the secondary air ports of the furnace in the vertical direction. Particularly, when the depth of the columnar recessed segment is equal to a half of the difference between the depth (or width) of the upper part of the furnace and the depth (or width) of the air distributor, the columnar recessed segment starts from the air distributor. When the depth of the columnar recessed segment is less than a half of the difference between the depth (or width) of the upper part of the furnace and the depth (or width) of the air distributor, the columnar recessed segment starts from a slope surface of the lower part bent inward of the front and rear walls (or left and right side walls) above the air distributor, at the same time, the depth of the columnar recessed segment is configured so that the bottom of the columnar recessed segment is lower than the secondary air ports. In the above two conditions, the water-cooling tubes at the top of the columnar recessed segments are drawn back onto the flat surface where the unrecessed portion is located, which can simplify the arrangement of top header of the circulating fluidized bed boiler. In the above two cases, when the columnar recessed segments are provided in the left and right side walls, the depth by which the columnar recessed segments are recessed toward the inside of the furnace is not larger than a half of the difference between the width of the furnace and the width of the air distributor; when the columnar recessed segments are provided in the front and rear walls, the depth by which the columnar recessed segments toward the inside of the furnace is not larger than a half of the difference between the depth of the furnace and the depth of the air distributor.

It should be noted that in the present specification the depth of the columnar recessed segment is defined as a distance from the point in the columnar recessed segment closest to the center of the furnace to the flat surface where the unrecessed portion of the water walls is located.

Preferably, the top of the columnar recessed segment is configured to be a flat surface extending toward the inside of the furnace. Furthermore, an afterburning air port is provided on or above the flat surface, which can decrease the concentration of NOx in the flue gas and increase the fluidization velocity above the columnar recessed segment.

In an optional embodiment, the columnar recessed segment extends from the air distributor to the ceiling 11 in the vertical direction, and the columnar recessed segment in a cross section of the furnace is located between adjacent flue gas outlets or/and outside the flue gas outlets (for example, at a corner of the furnace) and does not overlap with the flue gas outlets of the furnace. When the top of the columnar recessed segment extends to the ceiling, an additional duct is formed at the flue gas outlet of the furnace, lengthening cyclone inlet section, which can improve the separation efficiency of the cyclone.

In an optional embodiment, the furnace may comprise three flue gas outlets in the upper part of the rear wall and are connected with three cyclones respectively; and the rear wall is provided with two columnar recessed segments, one of which is arranged between one pair of adjacent flue gas outlets among the three flue gas outlets, and the other of which is arranged between the other pair of adjacent gas outlets among the three flue gas outlets. It is preferred that when the columnar recessed segments are located in the rear wall, the depth by which the columnar recessed segments are recessed toward the inside of the furnace is not larger than a half of the difference between the depth of the furnace and the depth of the air distributor.

In an optional embodiment, the furnace may comprise two furnace flue gas outlets provided in the upper part of the left side wall and two furnace flue gas outlets provided in the upper part of the right side wall, and these four furnace flue gas outlets are connected with four cyclones respectively; and the left side wall is provided with one columnar recessed segment arranged between the two flue gas outlets in the upper part of the left side wall, and the right side wall is provided with one columnar recessed segment arranged between the two flue gas outlets in the upper part of the right side wall, and so is for the right side wall. It is preferred that when the columnar recessed segments are provided in the left and right side walls, the depth by which the columnar recessed segments are recessed toward the inside of the furnace is not larger than a half of the difference between the width of the furnace and the width of air distributor.

In an optional embodiment, the furnace may comprise three furnace flue gas outlets provided in the upper part of the left side wall and three furnace flue gas outlets provided in the upper part of the right side wall, and these six furnace flue gas outlets are connected with six cyclones respectively; and the left side wall is provided with two columnar recessed segments, one of which is arranged between one pair of adjacent flue gas outlets in the left side wall, and the other of which is arranged between the other pair of adjacent flue gas outlets in the left side wall the right side wall is provided with two columnar recessed segments, one of which is arranged between one pair of adjacent flue gas outlets in the right side wall, and the other of which is arranged between the other pair of adjacent flue gas outlets in the right side wall. It is preferred that when the columnar recessed segments are located in the left and right side walls, the depth by which the columnar recessed segments are recessed toward the inside of the furnace is not larger than a half of the difference between the width of the furnace and the width of air distributor.

In an optional embodiment, the columnar recessed segment is provided with one or more layers of secondary air ports. The secondary air ports may be arranged in a flat part or at a corner of the columnar recessed segment so that the secondary air can be blown into the center region of the furnace from the closest position to the center region and the mixing effect is improved. At the same time, the conventional secondary air ports may be provided in the unrecessed segments of the side walls of the furnace.

As for the columnar recessed segment with a flat surface facing the center of the furnace, for example, the columnar recessed segment with a cross section of half oblong, rectangle, isosceles trapezoid or half hexagon, panel heating surface may be provided at the flat surface of the columnar recessed segment facing the center of the furnace. As for the columnar recessed segment at the corner of the furnace, panel heating surface may be provided at the side wall of the furnace where no furnace flue gas outlet is provided, because the gas into the cyclone at this time cannot abrade the side wall.

Hereafter, it will further describe the present invention according to embodiments with reference to the drawings.

Embodiment 1

Figure 2:
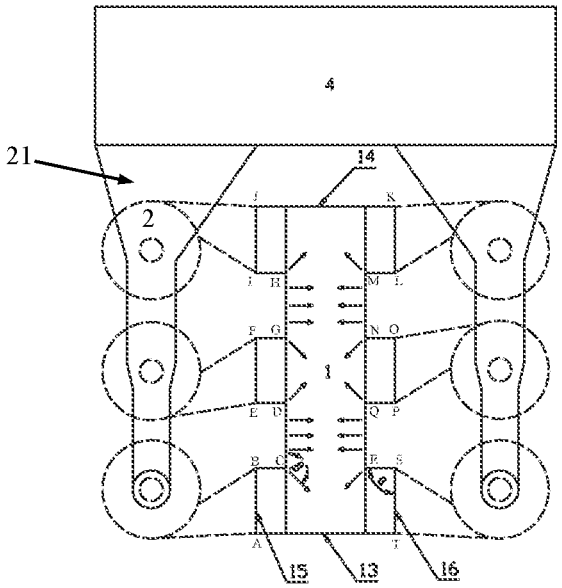

The circulating fluidized bed boiler shown in FIGS. 1-2 comprises six cyclones arranged outside left and right side walls, respectively. There are two vertical columnar recessed segments extending from air distributor to the furnace ceiling in the left and right side walls, respectively, so that the cross section of furnace exhibits a polygon ABCDEFGHIJKLMNOPQRST. The side walls and the columnar recessed segments are all constructed by vertical water walls. Three furnace flue gas outlets AB, EF and IJ are provided in the upper part of the left side wall AJ, and two columnar recessed segments are provided between the furnace flue gas outlets and exhibit rectangle notches BCDE and FGHI in the view of furnace cross section. The notch width (that is, the columnar recessed segment width) is equal to the net distance between the furnace flue gas outlets, that is, CD=BE, GH=FI. The right side wall TK has two rectangle notches SRQP and ONML, which are designed the same as those of the left side wall. The depth of the columnar recessed segment d is equal to a half of the difference between the width AT of the upper part of the furnace and the width UX of air distributor. In this way, the projections of edges CD, GH of the left side notches and edges RQ, NM of the right side notches on the air distributor just coincide with left and right side edges of the air distributor, respectively.

The edge CD of the notch BCDE is parallel to the left side wall AJ and is provided with secondary air ports Y. The secondary air is blown in a direction perpendicular to the edge CD. The other three notches FGHL SRQP and ONML, are designed the same as the notch BCDE. In addition, the unrecessed portion of the left and right side walls is provided with secondary air ports Y at the corners C D of the notch BCDE, or at any one corner of the other three notches FGHI, SRQP and ONML, in order to blow the secondary air into the furnace at an angle β of 60 degrees to 120 degrees. At the same time, the conventional secondary air ports may be provided in the unrecessed segments of the side walls of the furnace.

In the practical application, the corner of the notch may be configured to be a chamfered corner formed by two to four water cooling tubes so that the secondary air ports can be easily provided at the corner of the notch.

Figure 3:
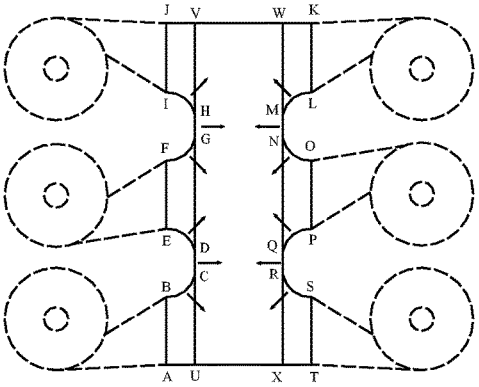
FIGS. 3, 4 and 5 are illustrative top views of optional examples of the embodiment 1, respectively.
Figure 4:
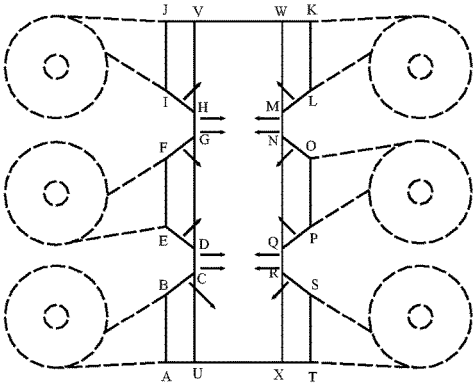
Figure 5:
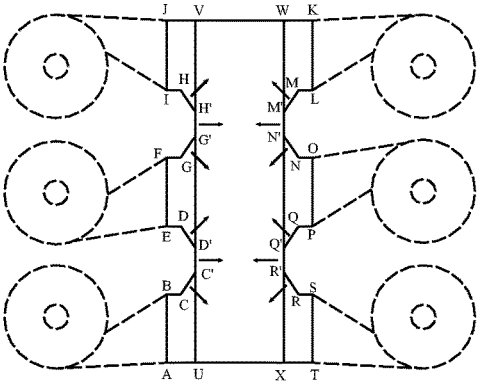

The notch of this embodiment may exhibit in the form of other shapes, for example, a half oblong shape, an isosceles trapezoid shape or a half octagon shape as shown in FIGS. 3-5.

Embodiment 2

Figure 6:
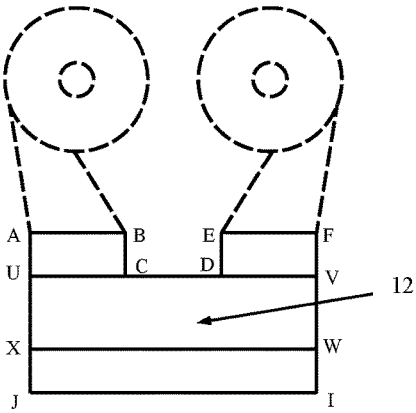
FIGS. 6 and 7 are illustrative top and left views of a circulating fluidized bed boiler according to an exemplary embodiment 2 of the present invention, respectively.
Figure 7:
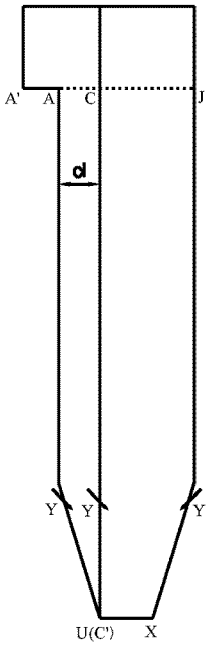

In the circulating fluidized bed boiler shown in FIGS. 6-7, two furnace flue gas outlets AB, EF are provided in the upper part of the rear wall and connected with two cyclones, respectively. Solid outlets of the cyclones are connected with a loop-seal 3 (as shown in FIG. 1), the loop-seal is connected with the lower part of the furnace, the flue gas outlet of the cyclone is connected with flue gas duct 4 (as shown in FIG. 2).

There is one vertical columnar recessed segment BCDE in the furnace rear wall AF, so that the cross section of the furnace exhibits a rectangle with a rectangle notch, which is located between two furnace flue gas outlets AB and EF. The width of the notch is equal to the net distance between the two furnace flue gas outlets, and the depth is equal to a half of the difference between the width AT of the upper part of the furnace and the width UX of air distributor, and the height is equal to the height of the furnace (that is, the columnar recessed segment extends from the air distributor to the ceiling).

A plurality of secondary air ports Y with the same height are provided in the column surface of the columnar recessed segment parallel to the rear wall, that is, a layer of secondary air ports Y. Meanwhile, the secondary air ports may be arranged in unrecessed flat surfaces of the front and rear walls.

Figure 8:
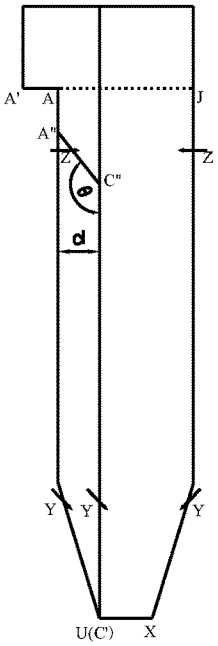
FIGS. 8, 9 and 10 are illustrative left views of optional examples of the embodiment 2, respectively.

At the same time, the height of the columnar recessed segment may be lower than the furnace height. In this case:

When the depth of the columnar recessed segment d is equal to a half of the difference between the width AT of the upper part of the furnace and the width UX of air distributor, the columnar recessed segment may be terminated at or below the bottom edge of the furnace flue gas outlet by a section of slope surface, for example, the slope surface C"C'A" shown in FIG. 8. Rows of bent tubes may have an angle θ larger than 90 degrees and smaller than 165 degrees. The height of the columnar recessed segment may be larger than 50% of the total furnace height.

Figure 9:
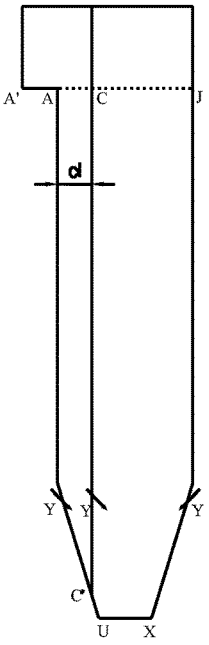
Figure 10:
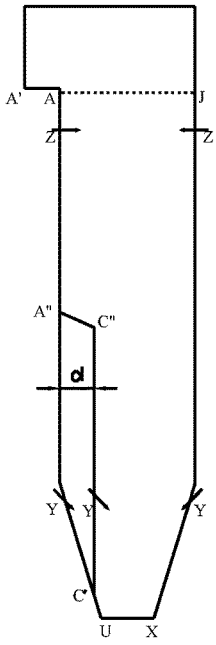
Figure 11:
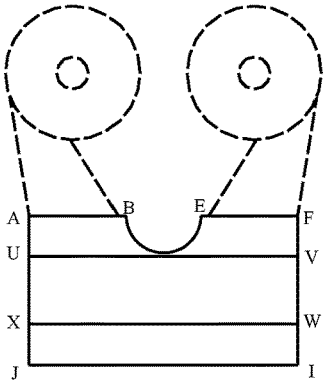
FIGS. 11, 12, 13 and 14 are illustrative top views of optional examples of the embodiment 2, respectively.
Figure 12:
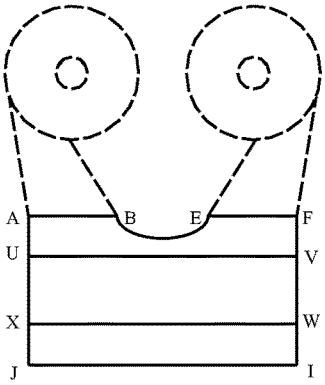
Figure 13:
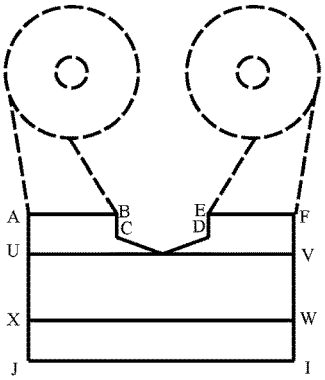
Figure 14:
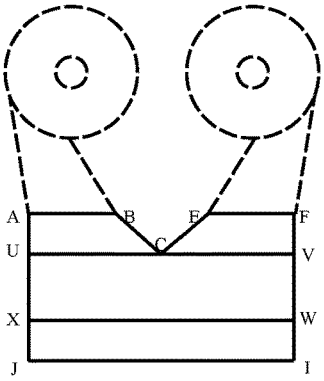

When the depth of the columnar recessed segment d is less than a half of the difference between the width AT of the upper part of the furnace and the width UX of air distributor, the columnar recessed segment extends upward from a slope surface of the lower part of side walls of the furnace above the air distributor and below the lowest layer of secondary air ports. The top of the columnar recessed segment may extend to the ceiling of the furnace, or may end at or below the bottom edges AA' and TT' of the flue gas outlets (as shown in FIGS. 9-10).

Also, the notch may have a shape of half circle, half oblong, half hexagon or triangle, and the secondary air ports may be provided in the column surface where the notch is located, as shown in FIGS. 11-14.

Embodiment 3

Figure 15:
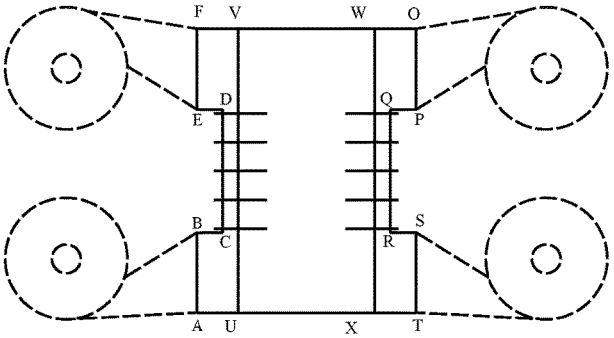
FIGS. 15 and 16 are illustrative top and front views of a circulating fluidized bed boiler according to an exemplary embodiment 3 of the present invention, respectively.
Figure 16:
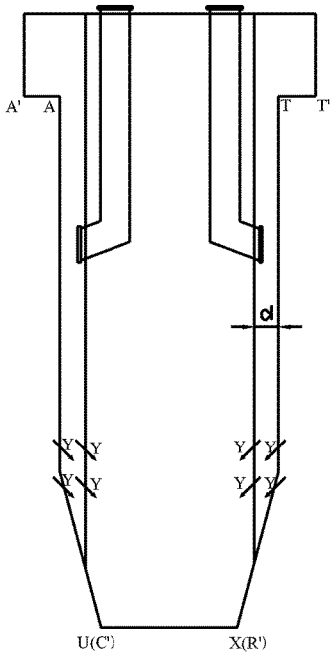

In the circulating fluidized bed boiler shown in FIGS. 15-16, each of the left and right side walls of the furnace is provided with two flue gas outlets, and these four furnace flue gas outlets are connected with four cyclones respectively. Each of the left and right side walls is provided with a vertical columnar recessed segment. Therefore, the cross section of the furnace at the furnace flue gas outlet exhibits a rectangle with two symmetrical rectangular notches, that is, 'I'-shape. The notches are located respectively between two furnace flue gas outlets at the same side wall. The width of the notch is equal to the net distance between the two furnace flue gas outlets, the depth is less than a half of the difference between the depth of the upper part of the furnace and the depth of the air distributor, and the height is equal to 90% of the furnace height. The columnar recessed segment extends from a position above the air distributor and below the lower layer of secondary air ports to the ceiling of the furnace.

A column surface of the columnar recessed segment parallel to the left and right side walls is provided with two layers of secondary air ports. In addition, panel heating surface may be provided at the upper portion of column surface of the columnar recessed segment parallel to the left and right side walls.

Embodiment 4

Figure 17:
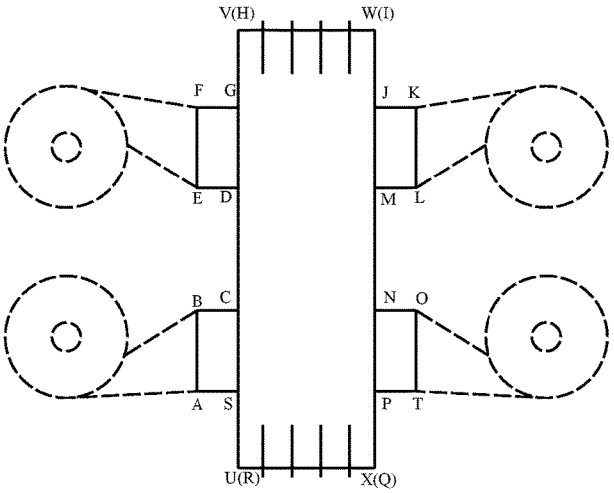
FIGS. 17 and 18 are illustrative side and front views of a circulating fluidized bed boiler according to an exemplary embodiment 4 of the present invention, respectively.
Figure 18:
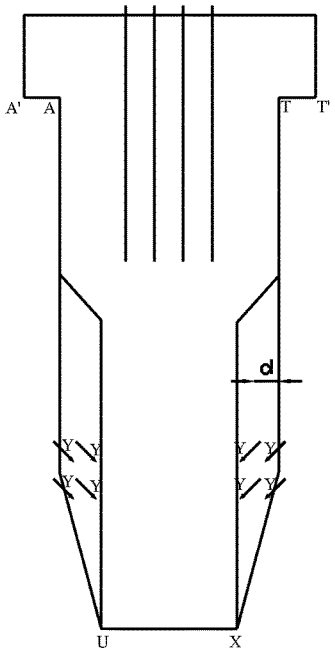

In the circulating fluidized bed boiler shown in FIGS. 17-18, each of the left and right side walls of the furnace is provided with two flue gas outlets, and these four furnace flue gas outlets are connected with four cyclones respectively. Each of the left and right side walls is provided with a vertical column recessed segment and the furnace is provided at its four corners with four vertical columnar recessed segments respectively. Therefore, the cross section of the furnace at the flue gas outlet exhibits a rectangle with six symmetrical rectangular notches, that is, '#'-shape. The notches are located between two flue gas outlets in the same side wall and at four corners of the furnace, respectively. The width of notches BCDE and ONML is equal to the net distance between the two furnace flue gas outlets in the same side wall. The width of notches RSA, QPT, UK and FGH is equal to ⅔ of the net distance between the two furnace flue gas outlets in the same side wall. The depth of six notches each is equal to a half of the difference between the depth of the upper part of the furnace and the depth of air distributor, the height equal to 60% of the furnace height. Each of the six columnar recessed segments extends from the air distributor to a position above the upper layer of secondary air ports and below the furnace flue gas outlets.

A column surface of the columnar recessed segment parallel to the left and right side walls and the corner of the column surface are provided with two layers of secondary air ports Y. In addition, panel heating surface may be provided at the middle-upper parts of the front and rear walls of the furnace.

Embodiment 5

Figure 19:
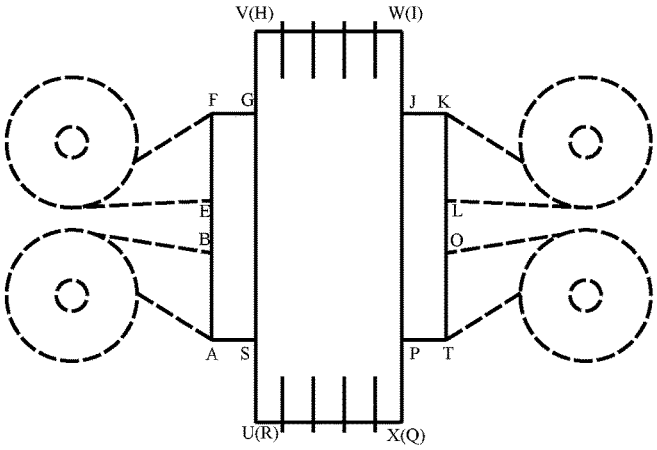
FIG. 19 is an illustrative top view of a circulating fluidized bed boiler according to an exemplary embodiment 5 of the present invention.

In the circulating fluidized bed boiler shown in FIG. 19, there are two furnace flue gas outlets in the left and right side walls, and these four furnace flue gas outlets are connected with four cyclones respectively. There is one vertical columnar recessed segment at each corner. Therefore, the cross section of the furnace flue gas outlet exhibits a rectangle with four rectangular notches, that is, the cross section of the flue gas outlet is in '+'-shape. The notches are located outside two furnace flue gas outlets in the same side wall, that is, at four corners of the furnace, respectively. The width of the notches is twice the net distance between the two furnace flue gas outlets in the same side wall, that is, SR=GH=2EB, IJ=PQ=2LO.

The depth of the six notches is equal to a half of the difference between the depth of the upper part of the furnace and the depth of an air distributor, and the height of the notch is equal to the furnace height.

A column surface of the columnar recessed segment parallel to the left and right side walls and the corner of the column surface are provided with two layers of secondary air ports. In addition, panel heating surface may be provided in the middle-upper upper parts of the front and rear walls of the furnace.

Embodiment 6

Figure 20:
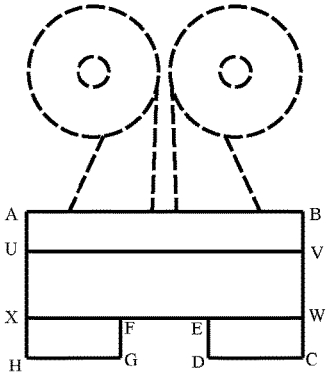
FIG. 20 is an illustrative top view of a circulating fluidized bed boiler according to an exemplary embodiment 6 of the present invention.

In the circulating fluidized bed boiler shown in FIG. 20, there are two furnace flue gas outlets in the upper part of rear wall and connected with two cyclones, respectively. There is a vertical columnar recessed segment just at the middle of the front wall. Therefore, the cross section of the furnace at the furnace flue gas outlet exhibits a rectangle with a rectangular notch. The notch is located opposite to the furnace flue gas outlet. The width of the notch is fourfold the net distance between the two furnace flue gas outlets. The depth of the notch is equal to a half of the difference between the depth of the upper part of the furnace and the depth of the air distributor, and the height of the notch is equal to the furnace height.

A column surface of the columnar recessed segment parallel to the front wall is provided with a layer of secondary air ports. In addition, the lower parts of the front and rear walls are provided with conventional secondary air ports.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

The invention claimed is:

1. A circulating fluidized bed boiler, comprising:

a furnace defined and enclosed by a water wall, a ceiling and an air distributor, the air distributor being provided with a primary air port, the water wall comprising front and rear walls and left and right side walls formed by water cooling wall tubes, wherein the water wall is provided with secondary air ports in a lower part thereof, and wherein furnace flue gas outlets are provided in an upper part of the furnace;

at least two cyclones connected to the furnace flue gas outlets; a loop-seal connected to solid outlets of the cyclones and a lower part of the furnace, respectively; and a flue gas duct connected to flue gas outlets of the cyclones, wherein the water cooling wall tubes of the water wall form at least one vertical columnar recessed segment recessed toward an inside of the furnace and located between two adjacent furnace flue gas outlets, wherein the at least one vertical columnar recessed segment forms at least a portion of an outer surface of the water wall such that the water wall and the furnace have a cross-section of a polygon shape, not including a rectangular shape, in a plane perpendicular to the vertical direction where the at least one vertical columnar recessed segment is located, wherein the at least one vertical columnar recessed segment extends at least 15% of the height of the furnace in a vertical direction, wherein the secondary air ports are arranged in a flat part and/or at a corner of the at least one vertical columnar recessed segment, wherein the at least one columnar recessed segment has a top configured to be a flat surface extending toward the inside of the furnace; and wherein an afterburning air port for blowing afterburning air is provided on the flat surface.

2. The circulating fluidized bed boiler according to claim 1, wherein the at least one columnar recessed segment is provided in at least one of the left and right side walls, and the depth by which the at least one vertical columnar recessed segment is recessed toward the inside of the furnace is not larger than a half of the difference between the width of the furnace and the width of the air distributor.

3. The circulating fluidized bed boiler according to claim 1, wherein a cross section of the at least one columnar recessed segment is shaped as one of the following: half circle, half oval, half oblong, rectangle, triangle, isosceles trapezoid and half octagon.

4. The circulating fluidized bed boiler according to claim 1, wherein the at least one columnar recessed segment extends from the air distributor to the ceiling in the vertical direction, and in a cross section of the furnace the at least one columnar recessed segment is located between adjacent furnace flue gas outlets and does not overlap with the furnace flue gas outlets.

5. The circulating fluidized bed boiler according to claim 4, wherein the furnace comprises three furnace flue gas outlets provided in an upper part of the left side wall and three furnace flue gas outlets provided in an upper part of the right side wall, and the six furnace flue gas outlets are connected to six cyclones respectively; and wherein the left side wall is provided with two columnar recessed segments with one arranged between one pair of adjacent furnace flue gas outlets in the left side wall and the other arranged between the other pair of adjacent furnace flue gas outlets in the left side wall; and wherein the right side wall is provided with two columnar recessed segments with one arranged between one pair of adjacent furnace flue gas outlets in the right side wall and the other arranged between the other pair of adjacent furnace flue gas outlets in the right side wall.

6. The circulating fluidized bed boiler according to claim 5, wherein the columnar recessed segments are provided in the left and right side walls, and the depth by which the columnar recessed segments are recessed toward the inside of the furnace is not larger than a half of the difference between the width of the furnace and the width of the air distributor.

* * * * *